US009107487B2

(12) United States Patent
Gueret

(10) Patent No.: US 9,107,487 B2
(45) Date of Patent: Aug. 18, 2015

(54) MASCARA BRUSH

(75) Inventor: Jean-Louis Gueret, Paris (FR)

(73) Assignee: L'OREAL, Paris (FR)

( * ) Notice: Subject to any disclaimer, the term of this patent is extended or adjusted under 35 U.S.C. 154(b) by 534 days.

(21) Appl. No.: 12/991,760

(22) PCT Filed: Jun. 19, 2009

(86) PCT No.: PCT/IB2009/052641

§ 371 (c)(1),
(2), (4) Date: Feb. 8, 2011

(87) PCT Pub. No.: WO2009/153761

PCT Pub. Date: Dec. 23, 2009

(65) Prior Publication Data

US 2011/0129286 A1 Jun. 2, 2011

Related U.S. Application Data

(60) Provisional application No. 61/080,581, filed on Jul. 14, 2008.

(30) Foreign Application Priority Data

Jun. 20, 2008 (FR) ..... 08 54111

(51) Int. Cl.

| | |
|---|---|
| ***A46B 11/00*** | (2006.01) |
| ***A45D 40/26*** | (2006.01) |
| ***A46B 9/02*** | (2006.01) |

(52) U.S. Cl.

CPC ..... *A45D 40/267* (2013.01); *A46B 9/021* (2013.01); *A45D 2200/207* (2013.01); *A46B 2200/1053* (2013.01)

(58) Field of Classification Search

CPC ... A45D 40/267; A45D 40/265; A46B 9/021; A46B 2200/1053; A46B 3/18

USPC ..... 401/121–122, 126–130; 132/218

See application file for complete search history.

(56) References Cited

U.S. PATENT DOCUMENTS

| | | | |
|---|---|---|---|
| 1,296,719 | A | 3/1919 | Veeck |
| 1,333,663 | A | 3/1920 | Kirby |
| 4,898,193 | A | 2/1990 | Gueret |

(Continued)

FOREIGN PATENT DOCUMENTS

| | | | |
|---|---|---|---|
| EP | 0 832 580 | A1 | 4/1998 |
| EP | 1 188 393 | A1 | 3/2002 |

(Continued)

OTHER PUBLICATIONS

International Search Report issued in Application No. PCT/IB2009/052641; Dated Jan. 15, 2010.

(Continued)

*Primary Examiner* — Jennifer C Chiang
(74) *Attorney, Agent, or Firm* — Oliff PLC

(57) ABSTRACT

A reservoir and application device including an applicator having a stem and a brush at the end of this stem, the brush presenting a largest transversal dimension between 9 and 14 mm, the brush being at least 30% wider than it is thick in cross section, a reservoir containing the product to be applied, having a wiper member defining a wiper orifice traversed by the brush when it is removed from the reservoir, the diameter of the wiper orifice being between 2.5 and 5.5 mm.

17 Claims, 5 Drawing Sheets

(56) References Cited

U.S. PATENT DOCUMENTS

Figure 1:
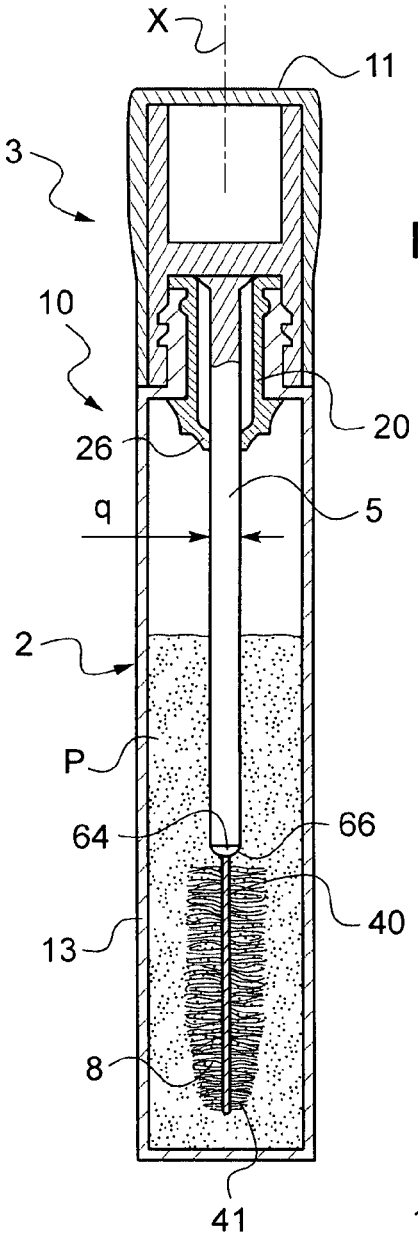

| | | | | |
|---|---|---|---|---|
| 5,335,465 | A | 8/1994 | Gueret | |
| 5,551,456 | A | 9/1996 | Hartel | |
| 5,599,225 | A | 2/1997 | Warner et al. | |
| 5,875,791 | A * | 3/1999 | Sheffler et al. | 132/218 |
| 5,876,138 | A | 3/1999 | Gueret | |
| 5,937,870 | A * | 8/1999 | Gueret | 132/218 |
| 6,227,737 | B1 * | 5/2001 | Lightfoot | 401/129 |
| 6,237,609 | B1 * | 5/2001 | Vasas | 132/218 |
| 6,341,913 | B1 | 1/2002 | Wilson-Jackson | |
| 6,508,603 | B1 * | 1/2003 | Vasas | 401/129 |
| 7,069,936 | B2 | 7/2006 | Gueret | |
| 7,125,188 | B2 * | 10/2006 | Gueret | 401/129 |
| 7,171,969 | B2 * | 2/2007 | Gueret | 132/218 |
| 7,229,228 | B2 * | 6/2007 | Dieudonat et al. | 401/122 |
| 7,278,798 | B1 * | 10/2007 | Kearney | 401/129 |
| 7,309,183 | B2 * | 12/2007 | Dumler | 401/155 |
| 2003/0213498 | A1 | 11/2003 | Gueret | |
| 2004/0168698 | A1 | 9/2004 | Gueret | |
| 2004/0240926 | A1 | 12/2004 | Gueret | |
| 2006/0013639 | A1 | 1/2006 | Gueret | |
| 2006/0070635 | A1 * | 4/2006 | Dumler et al. | 132/218 |
| 2007/0127974 | A1 * | 6/2007 | Chang et al. | 401/129 |
| 2008/0023020 | A1 | 1/2008 | Gueret | |
| 2008/0107470 | A1 | 5/2008 | Gueret | |
| 2008/0245382 | A1 | 10/2008 | Marciniak-Davoult et al. | |
| 2008/0271746 | A1 | 11/2008 | Gueret | |
| 2009/0320872 | A1 | 12/2009 | Vandromme | |
| 2010/0294299 | A1 | 11/2010 | Gueret | |
| 2011/0030713 | A1 | 2/2011 | Gueret | |

FOREIGN PATENT DOCUMENTS

| | | | |
|---|---|---|---|
| EP | 1 917 883 | A2 | 5/2008 |
| EP | 1 932 444 | A1 | 6/2008 |
| FR | 2 605 505 | A1 | 4/1988 |
| FR | 2 872 999 | A1 | 1/2006 |
| FR | 2 882 506 | A1 | 9/2006 |
| GB | 2 170 996 | A | 8/1986 |
| WO | WO 95/17837 | A1 | 7/1995 |

OTHER PUBLICATIONS

Written Opinion of the International Searching Authority issued in Application No. PCT/IB2009/052641; Dated Jan. 15, 2010.

French Written Opinion issued in Application No. 09 51794; Dated Mar. 20, 2009 (With Translation Only).

French Search Report issued in Application No. 09 51794; Dated Feb. 9, 2010 (With Translation).

Office Action issued Mar. 14, 2012 in related U.S. Appl. No. 12/728,691.

Related U.S. Appl. No. 12/728,691.

Office Action issued Oct. 4, 2011 in related U.S. Appl. No. 12/728,691.

Office Action issued Sep. 27, 2012 in related U.S. Appl. No. 12/728,691.

US Office Action issued May 22, 2013 in related U.S. Appl. No. 12/728,691.

Oct. 1, 2013 Office Action issued in U.S. Appl. No. 12/728,691.

* cited by examiner

Fig.20
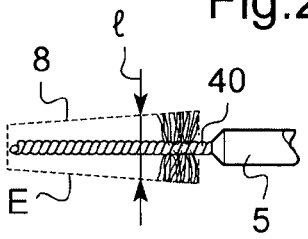
Fig.21
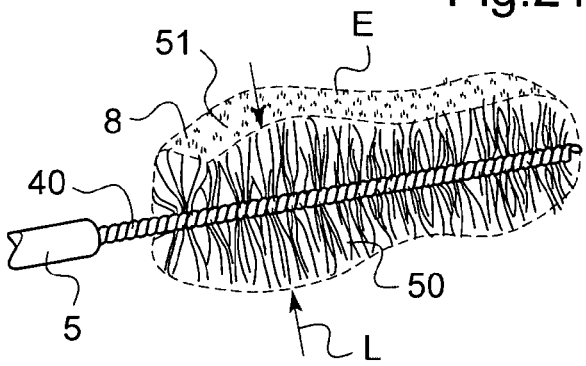
Fig.22
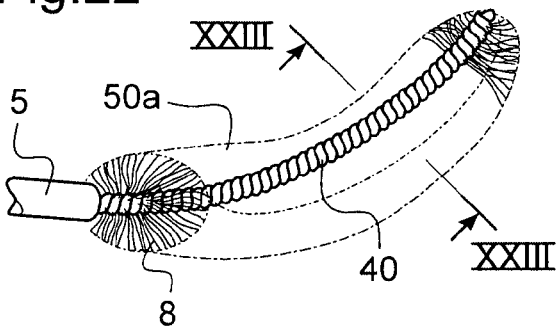
Fig.23
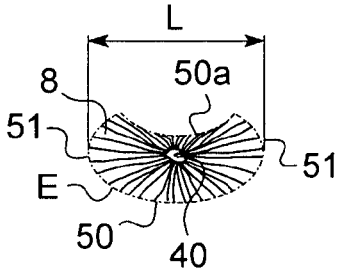
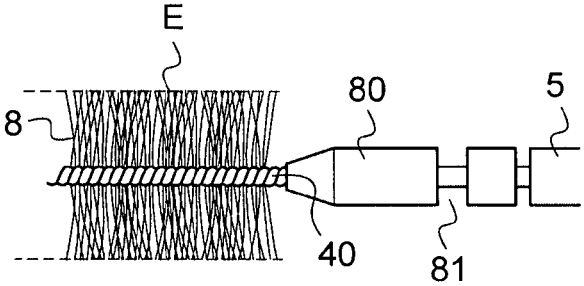
Fig.24
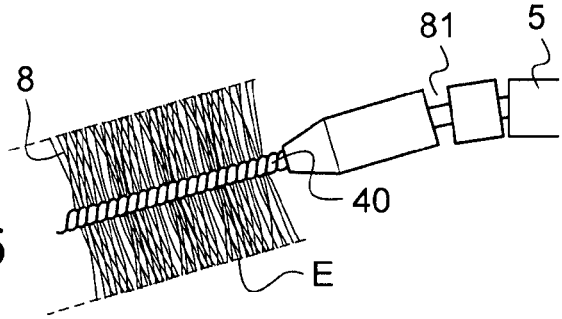
Fig.25

Fig.26
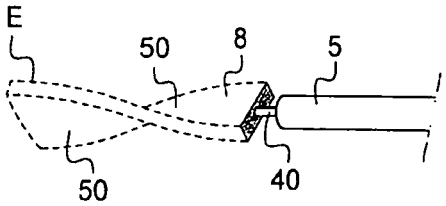
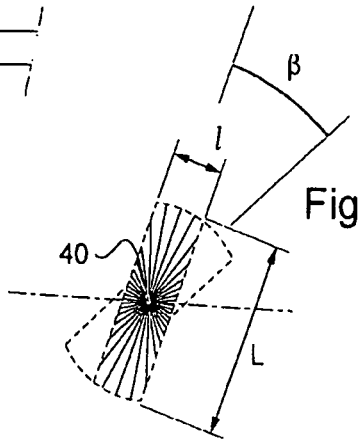
Fig.27
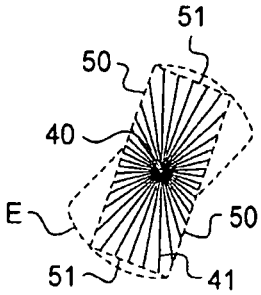
Fig.28
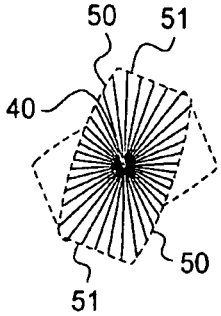
Fig.29
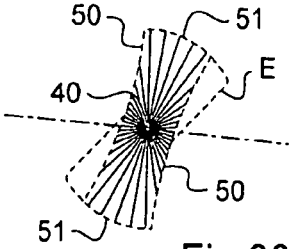
Fig.30

MASCARA BRUSH

The present disclosure pertains to a brush, reservoir and applicator for applying a product on the eyebrows or eyelashes, specifically a make-up or eyelash care product, a mascara for example.

The present disclosure more specifically concerns large brushes, that is to say, those brushes for which the surface envelope's largest transversal dimension is equal to or greater than 9 mm.

The present disclosure more specifically involves devices that have an applicator comprising a stem and, at one end thereof, a brush used to apply the product to the eyelashes or eyebrows.

This type of applicator, in which the brush includes a core comprising two intertwined metallic wire branches surrounded by bristles, is known.

The product is taken from the reservoir which has an opening equipped with a wiper member in order to remove any excess product present on the stem or on the brush. This wiper member is comprised of a lip, for example, made from an elastomer material, delineating a circular wiper orifice whose diameter could be approximately that of the stem.

U.S. Pat. No. 5,876,138 discloses a stem diameter of 3.5 mm compared with a larger brush diameter of 6 mm.

Application FR 2 605 505 describes brushes that may be wider than they are thick, held in a cylinder having a diameter of approximately 8 mm or held in a conical reservoir having a varying diameter between 8 mm and 5 mm.

WO 95/17837 describes a brush with a twisted core, having an envelope surface that is symmetrical when rotated, its proximal portion having bristles of an average length between 6 and 9 mm and a distal portion having bristles of an average length between 2.5 and 6.5 mm.

U.S. Pat. No. 5,937,870 and EP 0 832 580 describe a twisted core brush at least 50% wider than it is thick.

FR 2 872 999 discloses an applicator having an application member with a width of 9 mm.

US 2003/0213498 describes a twisted core brush having bristles between 3.5 to 9 mm in length.

EP 1 188 393 discloses a device comprising two brushes having twisted cores and symmetric envelope surfaces, each having different diameters, such that one has a diameter between 1 and 5 mm and the other has a diameter between 5 and 8 mm. It has been noted that if the diameter is too small, the brush is difficult to manufacture and is unable to deliver a sufficient amount of mascara, if the diameter is too large the brush becomes difficult to use.

Known large brushes are used with for example 6 mm diameter stems.

One issue that these brushes present is that, upon extraction from the reservoir, the end of the brush holds excess product due to the relatively large diameter of the wiper orifice, which may reduce the make-up results obtained.

Another issue with known large brushes is that they may be too tightly wiped to retain a heavy amount of make-up and they are only able to traverse wiper orifices which have a diameter that is roughly equal to that of the brush. This requires the reservoir to have a large diameter which may result in a reservoir that is not aesthetically pleasing.

Moreover, applying make-up with a large brush is not easy and the surface that makes contact with the eyelashes, at the end of the brush, is relatively narrow.

Based on these issues, among others, large brushes are relatively rare in the market.

There is still a need to improve large brushes.

The present disclosure aims to provide, according to one of its aspects, a device having a reservoir and an applicator comprising:

- an applicator having a stem and a brush at the end of this stem, the brush presenting a largest transversal dimension between 9 and 14 mm, 9 mm boundary included or excluded, the brush being at least 30% wider than it is thick in cross section,
- a reservoir containing the product to be applied, mascara for example, having a wiper member defining a wiper orifice traversed by the brush when it is removed from the reservoir, the diameter of the wiper orifice being between 2.5 and 5.5 mm.

The presence of relatively long bristles may facilitate passage through the wiper orifice because the long bristles are flexible. The length of the longest bristles, measured from the core, is for example greater than 3.5 mm. Due to the brush's flattened profile, passing the wiper member may be effectuated without excessively wiping the bristles along the entire periphery of the brush and the brush may pose less resistance when passing through the wiper orifice. The piston effect associated with the depression resulting from the extraction of the stem may have limited effects due to the air intake which may be produced as a result of the brush's flattened section. The bristles of the brush according to the present disclosure are other than flocking bristles.

The lateral faces of the brush may be heavily wiped which may facilitate eyelash separation during use. The main surfaces of the brush could be relatively heavily covered in product which may allow for a heavier application thereof to the eyebrows and/or eyelashes.

The subsequent results from the make-up application, in terms of elongation of the eyelashes for example, could be improved compared to a conventional 7.5 mm diameter brush.

The term between shall mean including boundaries unless otherwise indicated.

By "brush whose cross section is at least 30% wider than it is thick," it shall be understood that in at least one cross sectional plane perpendicular to the longitudinal axis of the core of the brush, the widest envelope surface is equivalent to at least 1.3 times the width of the thickness. The greatest width is also the diameter of the largest circle that the brush circumscribes. The thickness is measured in a direction that is perpendicular to that of the greatest width.

The envelope surface is defined as being the surface which rests on the free ends of the bristles.

The brush may be between 30% and 100% wider than it is thick, particularly between 35% and 55% wider than it is thick. The cross section of the brush may be rectangular, oval, oblong, rhomboid or kidney shaped, among others.

By "diameter of the wiper orifice" it shall be understood to mean the diameter of the largest circle contained in the wiper orifice. The wiper orifice may be circular or not.

The brush may comprise a core having a straight longitudinal axis. This core may be a twisted core, as conventional cores tend to be. The core may not be rectilinear, it may be curved on a plane parallel to the widest part of the brush or on a plane perpendicular to the widest section of the brush.

A large axis of the cross section of the brush may turn around the longitudinal axis of the core while progressing along it.

Thus, the brush may have an envelope surface of helical shape. This may facilitate the gradual curve of the eyelashes, in particular of the fringe of the eyelashes, by a rotational movement of the brush.

The wiper member entrance may have a diameter that is smaller than or equal to the largest lateral dimension of the brush. The entrance diameter is that through which the wiper member opens to the exterior of the reservoir.

The diameter of the wiper orifice may be between 2.5 and 4.5 mm.

The widest portion of the brush may be greater than its thickness by at least 3 mm when measured at the same location, according to the longitudinal axis of the brush, than that where the greatest width is measured.

The thickness of the brush may be anywhere between 2 and 7 mm, preferably between 2.5 and 6.5 mm, or 3 and 6 mm, or 3.5 and 5.5 mm.

The difference between the width of the brush and its thickness may be roughly equal to 30% of the diameter of the wiper orifice.

The stem may include two opposed main faces, the distance between them defining the thickness of the brush. These main faces may be flat and parallel.

The stem may comprise an elastically deformable distal portion. The distal portion may be formed by an endpiece fixed to the rest of the stem, for example, which may be made out of a more rigid material. The endpiece may include one or more ring shaped grooves which would make the stem more flexible.

The present disclosure aims also to provide, according to another of its aspects, a make-up application method regarding eyelashes and eyebrows, comprising applying product to the eyelashes or eyebrows with a device such as that described above.

The product contained in the reservoir may be a product that does not tend to overburden the eyelashes, for example, which may be applied through limited brushing in order to not further remove product which had been previously applied. Due to the large contact surface of the main faces of the brush, the brush allows applying make-up to the eyelashes while reducing the risk of removing the product.

Figure 2:
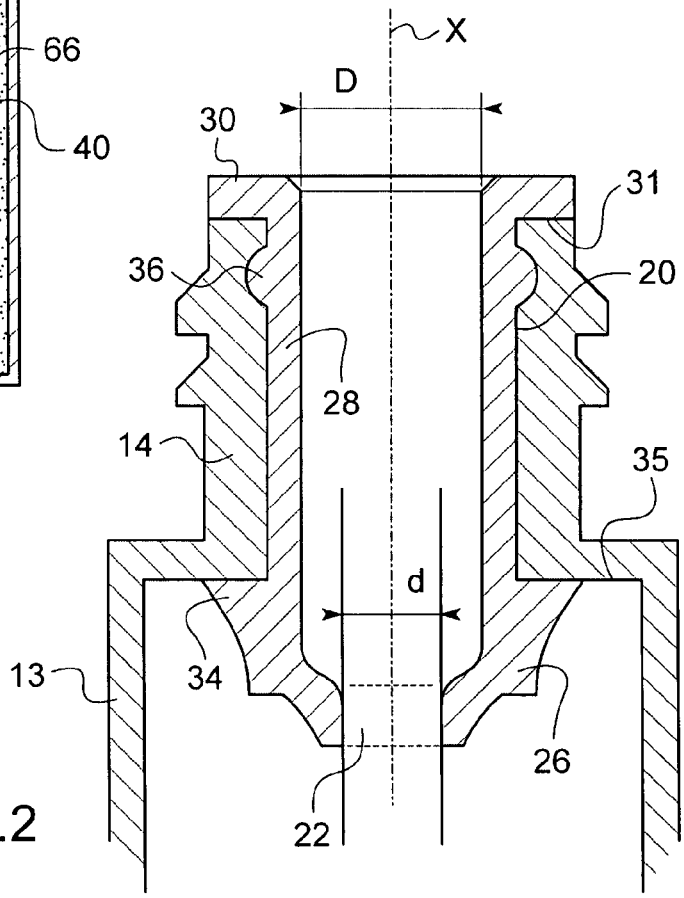
Figure 3:
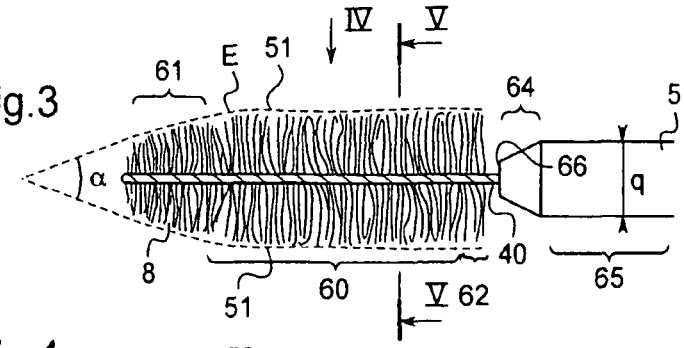
Figure 4:
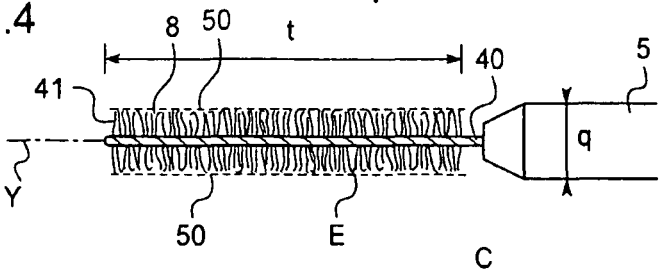
Figure 5:
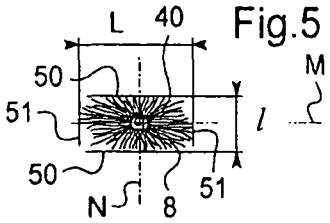
Figure 6:
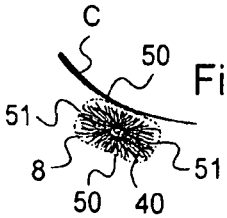

The present disclosure may be better understood by reading the detailed description which follows, as well as through the examples of the present disclosure, which should not be construed to limit the ways in which it may be produced, and the examination of the annexed drawings, of which:

FIG. 1 shows a schematic longitudinal cross section of an example of the reservoir and application a device according to embodiment the present disclosure, FIG. 2 depicts a detailed inset of the reservoir in FIG. 1 with the applicator removed, FIG. 3 depicts the frontal view of the brush featured in FIG. 1, FIG. 4 represents the brush in FIG. 1 seen from the side of arrow IV in FIG. 3, FIG. 5 is a schematic cross section according to V-V in FIG. 3, FIG. 6 illustrates the application of the product to the eyelash according to embodiment the present disclosure, FIGS. 7 through 11, 11A and 11B are views that correspond to various embodiments of FIG. 5, FIGS. 12 through 16, 16A and 16B are views that correspond to various embodiments of FIG. 3, FIGS. 17 through 20 are views that correspond to various embodiments of FIG. 4, FIG. 21 is a schematic representation, from a vantage point, of the envelope surface of a brush according to embodiment the present disclosure, FIG. 22 depicts, from a partial schematic vantage point, according to embodiment the present disclosure, FIG. 23 is a section according to XXIII-XXIII of FIG. 22, FIGS. 24 and 25 illustrate a stem with flexible distal section, according to embodiment the present disclosure, and FIGS. 26 through 30 illustrate a brush with an envelope surface having a twisted shape according to embodiment the present disclosure.

Reservoir and application device 10 shown in FIG. 1 comprise a reservoir 2 containing a product P to be applied to the eyelashes and/or eyebrows and an applicator 3 which may, be affixed to reservoir 2 in such a way that it is detachable.

Applicator 3 comprises a stem 5 with longitudinal axis X having a brush 8 at one end and, at the other end, a handle 11 which also serves as a sealed closing cap for reservoir 2. Reservoir 2 includes, as shown in FIG. 2, a body 13 with a threaded neck 14 upon which handle 11 may be screwed on in order to seal reservoir 2 e.g., hermetically. In another embodiment, applicator 3 attachment point to the reservoir may be produced in other various manners.

Neck 14 may house a wiper member 20 which, for example, could be placed in neck 14.

Wiper member 20 comprises a lip 26 which defines a wiper orifice 22 with a diameter d adapted to that of the stem 5.

Brush 8 may be affixed via a housing provided at the distal end of the stem.

The body 28 of wiper member 20 defines an orifice 22 with an entry diameter D which opens to the exterior. Lip 26 connects to the upper part of body 28.

Wiper member 20 may include an annular rim 30 for support between the upper extremity 31 and neck 14.

Wiper member 20 may also include, for example, an annular bead 36 which could be snapped into a groove in the interior of neck 14 and/or an annular shoulder 34 resting against a corresponding retaining element 35 formed within the reservoir at the base of neck 14.

It being understood that the disclosure is not limited to any one particular attachment method for wiper member 20 onto reservoir 2 and it may be attached in any desirable manner to neck 14, for example by forcible insertion, gluing, snapping into place, soldering, or molding. If desired, reservoir 2 may be manufactured without neck 14 that is thinner than the rest of the body. Wiper member 20 may be molded as a singular part made of substantially the same material as reservoir 2.

FIGS. 3 and 4 show a frontal view and a side view, respectively, of stem 5.

Stem 5 may comprise a twisted metallic core 40 which is attached to a housing at a distal end of stem 5.

Core 40 supports bristles 41, which may be either natural or synthetic, mixed (i.e., natural and synthetic) or not, and/or flaked or not.

Core 40 may be formed by two branches of a metallic wire bent into a U shape, bristles 41 being placed between the twisted wires of the core. In some embodiments, the diameter of the metallic wire can run from 0.1 mm to 1 mm, for example, and the diameter of the bristles may run between 0.06 mm and 0.35 mm, for example.

An envelope surface E, defined by the free ends of bristles 41, may include two opposed main surfaces 50 as is shown in FIGS. 4 and 5, flat and may be parallel to the longitudinal axis Y of core 40, upon a section 60. Core 40 is straight in the given example. Main surfaces 50 are connected by two lateral faces 51 which are convex towards the exterior, being formed, for example, by cylindrical sections about the Y axis.

The width L of brush 8 may be defined as the largest transversal dimension of brush 8 and its thickness l as being its smallest transversal dimension, that where width L is measured.

The width L is, for example, measured in a parallel manner to the median plane M of brush 8, which may be a symmetrical median plane, and thickness l may be, for example, measured in parallel to a median plane N perpendicular to median plane M, as illustrated in FIG. 5. Plane N may also be a symmetrical median plane. In some embodiments, the width L may be between 9 and 14 mm.

In some embodiments, the length t of the portion of core 40 that contains bristles may, for example, be between 9 and 35 mm.

Brush 8 may have a width L that remains constant on section 60 extending from the proximal extremity of brush 8 as seen in FIG. 3, with the width then decreasing over on a section 61 extending in the direction of proximal extremity 62 of brush 8 which elongates section 60. The decrease in the width of stem 5 within section 61 may arise according to two planes forming an angle $\alpha$ between them when brush 8 is viewed from the front as in FIG. 3.

Thickness l may be constant along the entire length t as is seen in FIG. 4. In some embodiments, (not shown), the thickness of brush 8 may gradually decrease over section 61.

In some embodiments, the length t, measured along the longitudinal axis of core 40, of section 60 of the width L, may be for example between 9 and 29 mm.

The diameter of stem 5 may decrease over distal portion 64 of stem 5 adjacent to its distal extremity 66 and may remain relatively constant, e.g., equal to q over the majority of stem 5 up to handle 11. If desired, the portion of stem 5 that rests in the wiper orifice 22 when applicator is placed in receptacle 2 may include an annular restraint in order to avoid constraining wiper lip 26 during storage.

Table 1 show various data associated with some embodiments of the present disclosure:

TABLE 1

| | | | | | | | | |
|---|---|---|---|---|---|---|---|---|
| diameter d (mm) wiper member | 3 | 4.2 | 4.15 | 4 | 3 | 5.5 | 5.5 | 4.5 |
| Width L of the brush (mm) | 9 | 9 | 9 | 10 | 11 | 12 | 13 | 14 |
| Thickness l of the brush (mm) | 4.5 | 6 | 5 | 2.5 | 2.5 | 5.5 | 7 | 4.5 |
| ratio L/l | 2 | 1.5 | 1.8 | 4 | 4.4 | 2.2 | 1.9 | 3.1 |

Diameter q of the stem 5 may correspond approximately to that of wiper orifice 22. In some embodiments, there is l=5 mm, L=9 or 10 mm, t=26 to 29 mm, d=4.15 mm resulting in, for example, $d \leq L/2$ or even $d \leq L/3$.

The values given in table 1 are not exhaustive. These dimensions may render brush 8 particularly efficient by creating a broad contact surface between brush 8 and an eyelash during a brush stroke, as depicted in FIG. 6, main surface 50 being able to come into contact with an eyelash C over a relatively substantial distance.

When brush 8 passes through wiper member 20, brush 8 may, for example, by its own deformation, fill the space available between main surfaces 50 and the interior surface of wiper member 20.

A cross section of brush 8 may have various shapes without departing from the scope of the present disclosure.

In order to illustrate some brush 8 cross sections consistent with embodiment of the present disclosure, FIGS. 7 through 11 are provided as examples.

Figure 7:
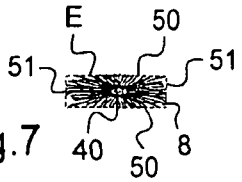

Brush 8 may include lateral surfaces 51, which may be parallel and flat, as illustrated in FIG. 7.

Figure 8:
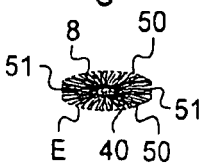

Main faces 50 may be flat and parallel, as illustrated in FIGS. 5 and 7, or, for example, convex towards the exterior, as illustrated in FIG. 8.

When main faces 50 are convex towards the exterior, lateral faces 51 may be flat and parallel, as illustrated in FIG. 8, or in some embodiments, can be convex towards the exterior, for example with a radius of curvature smaller than the main faces.

Figure 9:
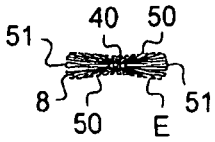

Main faces 50 may also, as illustrated in FIG. 9, be concave towards the exterior, this concavity being for example defined by a cylindrical surface or by intersecting faces creating a dihedron.

Figure 11:
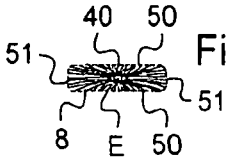
Figure 10:
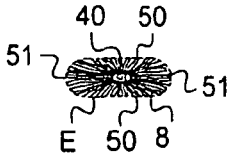

In some embodiments, ratio L/l can vary as illustrated in FIGS. 10 and 11.

Figure 11A:
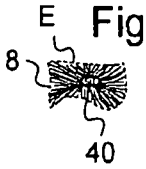
Figure 11B:
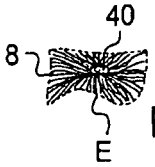

In some embodiments, a brush core cross section can be eccentric, as illustrated in FIG. 11A or 11B.

Such a brush cross section can have an asymmetrical shape, for example with two main faces having different shapes, e.g., one flat and the other with at least one crest and/or trough, as can be seen in FIGS. 11A and 11B.

Figure 12:
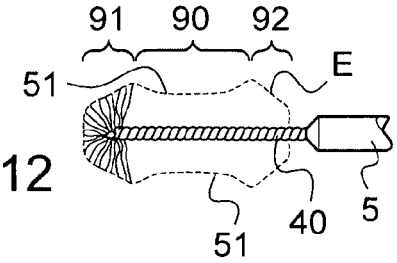

When viewed from the front, brush 8 can have, as can be seen in FIG. 12, lateral faces 51 which are not parallel or straight for at least a portion of the brush length, similar to that shown in FIG. 3. However, lateral faces 51, which are, for example, concave towards the exterior on portion 90 of the brush, may extend between one or more distal and proximal portions 92, which are each of decreasing width in some embodiments.

Figure 13:
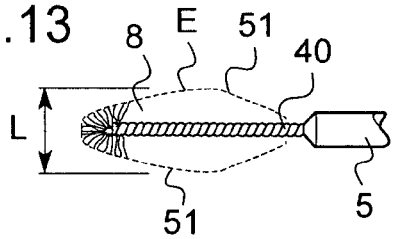

Brush 8 may also have, as illustrated in FIG. 13, lateral faces 51 which may be convex towards the exterior, for example following a rounded profile.

Figure 14:
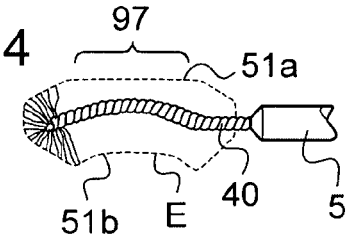
Figure 15:
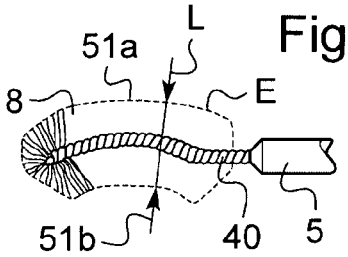

Core 40 can extend with respect to a longitudinal axis Y which is straight or, in another embodiment, curved, as illustrated in FIGS. 14 and 15.

In some embodiment e.g., that of FIG. 14, brush 8 has, when viewed from the front, on one portion 97 a flat lateral face 51*a* which is parallel to the longitudinal axis X of stem 5 and an opposed lateral face 51*b* being concave in the same direction.

In some embodiment e.g., that of FIG. 15, lateral face 51*a* is convex towards the exterior and lateral face 51*b* is concave towards the exterior, brush 8 being for example machined with a straight core 40 and two parallel lateral faces, then core 40 being curved keeping core 40 in a plane in such a way to give the two lateral faces the desired convexity and concavity.

Figure 16:
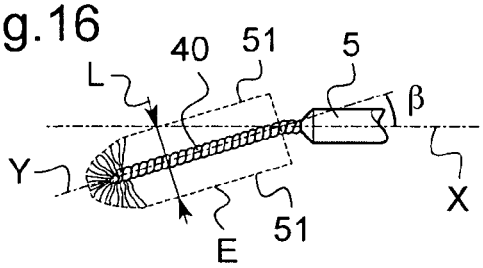

In some embodiments e.g., that of FIG. 16, core 40 is straight with respect to an axis Y on its portion having the bristles and making an angle $\beta$ with the X axis of stem 5.

Figure 16A:
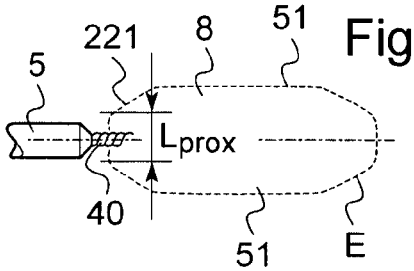
Figure 16B:
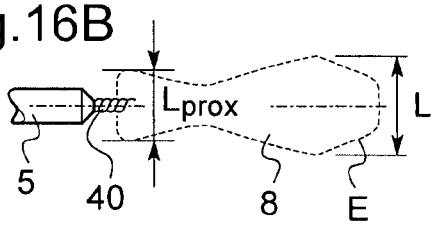

Brush 8 may have a proximal portion with a chamfer 221, with width $L_{prox}$ at its proximal extremity as illustrated in FIG. 16A. In some embodiments, brush 8 may have a proximal portion for which the width decreases towards the brush's distal extremity, as illustrated in FIG. 16B.

Figure 17:
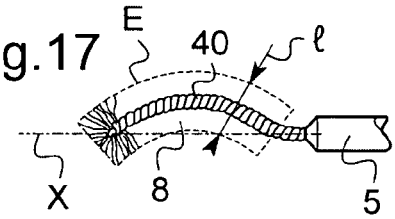

Brush 8 may also have a curvilinear core 40 when viewed from the side, as illustrated in FIG. 17. In such embodiments, the thickness l of the brush is substantially constant and core 40 is, for example, bent in such a way that the core's distal extremity is located approximately in alignment with the stem's 5 longitudinal axis X.

In some alternative embodiments, the core's 40 distal extremity may not, for example, cross a plane containing the stem's 5 longitudinal axis and an axis parallel to it around which core 40 is twisted.

Figure 18:
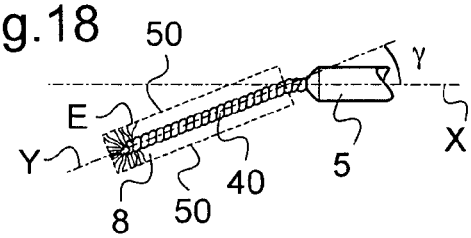

The example illustrated in FIG. 18 shows embodiments wherein core 40 whose bristle portion is straight and which makes angle $\gamma$ with the stem's 5 longitudinal axis X, core 40 being extending along around an axis which is, for example, parallel to the plane of principal faces 50.

Figure 19:
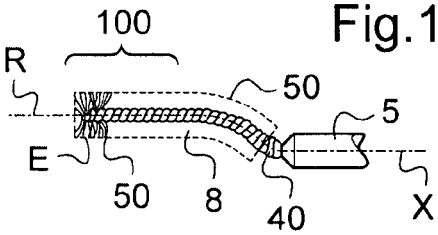

In some embodiments e.g. that of FIG. 19 a core 40 consisting of two curves, being extending initially from stem 5 towards the exterior, then being straightened in the other direction in such a way to have a distal portion 100 which has an axis R, being, for example, parallel to the stem's X axis. The axes around which core 40 is curved are, for example, parallel to one another and parallel to principal faces 50.

Core 40 can, as shown in the example in FIG. 19, be twisted in one direction and then in the other, for example twisted to the left on one half of its length and then curved to the right on the remaining half.

FIG. 20 shows that the brush thickness l may decrease in the direction of its distal extremity, for example linearly with respect to its distance from stem 5. There is, for example, a thickness l which is greatest at the stem side, having a value of between 3 and 6.5 mm and least at the distal extremity side of the core. In some embodiments, between for example 2.5 and 5 mm.

The example illustrated in FIG. 21 shows, in perspective, a brush embodiment for which lateral faces 51 are curved and pass, for example, by a minimum relative to the width, approximately at half the length of the portion of core 40 supporting the bristles.

Shown in FIGS. 22 and 23 is a brush having a spoon shape with, for example, on one side of the brush, main face 50*a* which is concave, being for example, twisted around the two perpendicular axes between them.

Stem 5 may be equipped at its extremity with an elastically deformable cap 80 which serves to support brush core 40 and which allows for a certain angular displacement when removing brush 8 from reservoir 2 or when applying make-up, as illustrated in FIG. 25. Cap 80 has, for example, a neck 81. Cap 80 is, for example, that such as described in EP 1 917 883 A2 and can be made at least partially from a material in the following non-exhaustive list: elastomer material, thermoplastic, thermoplastic elastomer, LDPE, PVC, PU, thermoplastic elastomer polyesters, preferably butene terephthalate and polytetramethylene oxide glycol ester copolymers, Hytrel®, EPDM, PDM, EVA, SIS, SEBS, SBS, latex, silicone, nitrile, butyl, polyurethane, polyether block amide, polyester. Cap 80 can be made with a material for which the hardness is for example between 25 in Shore A and 80 in Shore D, in some embodiments between 40 in Shore A and 70 in Shore D. The stem's 5 rigid section(s) can be made from a thermoplastic material, preferably one of the materials chosen from the following non-exhaustive list: HDPE, LDPE, linear PE, PT, PP, POM, PA, PET, PBT.

Shown in FIG. 26 is a twisted brush 8 which has an envelope surface of helical shape.

The brush comprises a core 40 supporting bristles 41 which may be either natural or synthetic, mixed or not, flaked or not, as previously described.

In some embodiments, core 40 is formed by two branches of a metallic wire bent into a U shape, bristles 41 being put between the twisted wires of the core. The diameter of the metallic wire can run from 0.1 to 1 mm for example. The diameter of bristles 41 may run between 0.06 mm and 0.35 mm for example.

Core 40 is straight in the given example, with a longitudinal axis being the same as the one of the stem 5. Main surfaces 50 of the envelope surface are connected by lateral faces 51, which are for example convex towards the exterior as illustrated.

Shown in FIG. 27 to 30 are examples of possible cross sections of twisted brush.

Brush 8 may have a rectangular cross section and parallel lateral faces 51, as illustrated in FIG. 28.

Main surfaces 50 may be parallel as illustrated in FIGS. 27 and 28 or convex towards the exterior as illustrated in FIG. 29.

When main surfaces 50 are convex towards the exterior, lateral faces 51 may be parallel as illustrated in FIG. 29 or in an unillustrated embodiment, convex towards the exterior, for example for a radius or curvature smaller than main faces 50.

Main faces 50 may also, as illustrated in FIG. 30, be concave towards the exterior, this concavity being for example defined by a portion of a circle or by intersecting faces creating a dihedron.

In an unillustrated embodiment, the cross section can have an asymmetrical shape, for example with two main faces having different shapes.

The large axis of brush 8 cross section turns with an angle β between the distal and proximal extremities of the portion of the brush's flattened profile which is for example greater than 20° and for example comprise between 20 and 80°.

Brush 8 may be made with a non symmetrical envelope surface, for example twisted as illustrated in FIG. 26 by twisting core 40 around its longitudinal axis. In another embodiment, the envelope surface is manufactured so as to have an helical shape or otherwise non-cylindrical.

Brush 8 can comprise at least one bristle having at least one wave, and, and can preferably comprise at least two bristles each one having at least one periodic pattern being different. The two different periodic patterns can belong to two distinct bristles or to the same bristle, and the waves can have different forms, for example a saw tooth form or a sinusoidal form, or having different amplitudes, or waves having different spatial frequencies as well. The term "periodic pattern," with respect to a bristle, is defined as a section of the bristle which noticeably and periodically reproduces itself along the length of the bristle.

Bristles 41 and brush 8 can undergo various treatments. Brush 8 can undergo any treatment, for example, thermal abrading.

Waved bristles can be implemented, a mix of bristles, natural or synthetic bristles, bristles having a particle load so as to give them magnetic properties or to reduce friction or any other suitable bristle may be implemented.

Brush 8 can comprise at least one portion having bent bristles extending from core 40 in an oriented manner, for example as described in the application US 2004/0168698. For the phrase "extending in an oriented manner," it should be understood that the bent bristles extend with a general orientation which is defined during the brush fabrication and not with a totally random orientation. Bristles 41 can be preferably oriented in the same circumferential direction around core 40. Bristles 41 can be bent by contact with a hot surface, e.g., a surface moving relative to brush 8.

Brush 8 may comprise at least two deformed bristles for example taken between two adjacent coils, these bristles having had material removed or having been crushed in at least one point on their length from core 40 and extending non-radially from this point towards the exterior, as described in the application US 2004/0240926. Each deformed bristle can comprise two straight portions having a bend between them. The two straight portions can have the same cross section. All of the deformed bristles can define the bends all of which are located noticeably at the same distance from core 40.

Bristles 41 can be natural or synthetic and for example be fabricated out of a material chosen among the non-exhaustive list: PE, PA, preferably PA6, PA6/6, PA6/10 or PA6/12, HYTREL®, PEBAX®, silicone, PU. Brush 40 can comprise bristles 41 having elastic properties, preferably bristles made from an elastomer. Bristles having magnetic properties can also be used. Brush 40 can be flaked. The bristles can be treated in a way which creates forks, balls or hooks at the ends. Bristles 41 can also be treated to present lowered frictional effects.

Bristles 41 can have a full circular section, circular trough, polygonal trough, for example a triangular trough. Bristles 41 can also have a trough section in the shape of a star, a multi-lobed section, which can be full, a flattened section, oval, in square form, H, barbell, a full triangular polygon form, square, pentagonal, semi-circular, trapezoidal, also in tile shape or any other desirable shape. Bristles 41 can have at least one capillary groove.

Brush 8 may be vibrated either by a generator installed in applicator 3, preferably on the handle 11, in a movable manner or not, or by an external vibrating element mounted on the user's finger.

A vibration generator is described in French patent application FR 2 882 506. The vibrations can allow the user to obtain better eyelash separation and in the case of using a composition having fibers, a better orientation of these and/or easier removal. During the removal, the application element can be subjected to vibrations from the vibration source, which can enable where desired, a more homogeneous load on the applicator 3.

The brush width L can be greater than the diameter D of the wiper member entrance or in other embodiments smaller.

The largest transverse dimension $L_{prox}$ of brush 8, measured at the envelope surface's proximal extremity E, can be greater than the largest interior diameter of wiper member 20. The greatest interior diameter of wiper member 20 can be less than or equal to the largest transverse dimension L of brush 8.

Brush 8 may comprise a core 40 twisted to the left or right or right and left.

In some embodiments, in order to make core 40, a double iron wire which is twisted on itself in order to hold bristles 41, which may allow for a more random distribution of the brush's free ends. Brush 8 may also be shaped by coiling two twisted cores each one bearing bristles around one another.

When the brush cross section is observed, core 40 may be centered. In other embodiments, core 40 may be eccentric in the brush cross section.

A wiper member may be used where the wiper orifice is defined by a waved lip. In this case, the orifice diameter is that of the largest cylinder found in the wiper orifice.

The term "comprising one" must be understood as being synonymous with "comprising at least."

The invention claimed is:

1. A device comprising:

an applicator having a stem and a brush at the end of this stem, the brush presenting a largest transversal dimension between 9 and 14 mm, the brush having a width and a thickness that are not equal, the brush being at least 30% wider than the brush is thick in cross section, and the brush having two principal parallel opposing faces defining the thickness of the brush, the brush having a proximal portion comprising a section on which the width remains constant and a distal portion that is of decreasing width adjacent to the section of constant width; and a reservoir containing the product to be applied, the reservoir having a wiper member defining a wiper orifice traversed by the brush when the brush is removed from the reservoir, a diameter of the wiper orifice being between 2.5 and 5.5 mm, the wiper member having an upper body part defining an entry diameter which is less than or equal to the largest transversal dimension of the brush.

2. The device according to claim 1, the diameter of the wiper orifice being between 2.5 and 4.5 mm.

3. The device according to claim 1, the width of the brush being at least 3 mm greater than the thickness of the brush.

4. The device of claim 1, the thickness of the brush being between 2.5 and 6.5 mm.

5. The device according to claim 1, the difference between the width of the brush and its thickness being equal, within a 30% margin, to the diameter of the wiper orifice.

6. The device of claim 1, said faces being parallel.

7. The device according to claim 1, the stem comprising an elastically deformable distal portion.

8. The device according to claim 1, the brush having a twisted core.

9. The device according to claim 1, the wiper orifice being circular.

10. The device according to claim 1, the values for the width and the thickness of the brush and the diameter of the wiper orifice being those contained in the following table:

| | | | | | | | | |
|---|---|---|---|---|---|---|---|---|
| diameter d (mm) wiper member | 3 | 4.2 | 4.15 | 4 | 3 | 5.5 | 5.5 | 4.5 |
| Width L of the brush (mm) | 9 | 9 | 9 | 10 | 11 | 12 | 13 | 14 |
| Thickness l of the brush (mm) | 4.5 | 6 | 5 | 2.5 | 2.5 | 5.5 | 7 | 4.5 |
| ratio L/l | 2 | 1.5 | 1.8 | 4 | 4.4 | 2.2 | 1.9 | 3.1. |

11. The device according to claim 10, a ratio of the largest transversal dimension over the thickness of the brush being between 1.3 and 5.

12. The device according to claim 1, the brush comprising lateral faces that are formed by cylindrical sections about the longitudinal axis.

13. The device according to claim 1, the diameter of the wiper orifice being smaller than or equal to half the width of the brush.

14. The device according to claim 1, the proximal portion comprising a chamfer.

15. A device comprising:

an applicator having a stem and a brush at the end of this stem, the brush being constituted by a twisted-wire core with bristles held by the twisted-wire core, the brush presenting a largest transversal dimension between 9 and 14 mm, the brush having a width and a thickness that are not equal, and the brush being at least 30% wider than the brush is thick in cross section, the brush having two principal parallel opposing faces defining the thickness of the brush, and a reservoir containing the product to be applied, having a wiper member defining a wiper orifice traversed by the brush when the brush is removed from the reservoir, a diameter of the wiper orifice being between 2.5 and 5.5 mm, the wiper member having an upper body part defining an entry diameter which is less than or equal to the largest transversal dimension of the brush, the brush comprising a core having a longitudinal axis that is curved on a plane perpendicular to the principal opposing faces of the brush, the longitudinal axis of the core presenting two curves around axes that are parallel to themselves and parallel to the principal faces of the brush.

16. The device according to claim 15, the principal faces being parallel.

17. The device according to claim 15, the brush comprising lateral faces that are formed by cylindrical sections about the longitudinal axis.

* * * * *